US011946175B2

(12) United States Patent
Blycker

(10) Patent No.: US 11,946,175 B2
(45) Date of Patent: Apr. 2, 2024

(54) SHEDDING METHOD AND APPARATUS USING AIR PRESSURE

(71) Applicant: TAPE WEAVING SWEDEN AB, Borås (SE)

(72) Inventor: Henrik Blycker, Öjersjö (SE)

(73) Assignee: TAPE WEAVING SWEDEN AB, Borås (SE)

( * ) Notice: Subject to any disclaimer, the term of this patent is extended or adjusted under 35 U.S.C. 154(b) by 106 days.

(21) Appl. No.: 17/296,603

(22) PCT Filed: Dec. 9, 2019

(86) PCT No.: PCT/EP2019/084263
§ 371 (c)(1),
(2) Date: May 25, 2021

(87) PCT Pub. No.: WO2020/120409
PCT Pub. Date: Jun. 18, 2020

(65) Prior Publication Data

US 2022/0002918 A1 Jan. 6, 2022

(30) Foreign Application Priority Data

Dec. 12, 2018 (EP) ..... 18211841

(51) Int. Cl.
*D03D 49/12* (2006.01)
*D03C 13/00* (2006.01)
(Continued)

(52) U.S. Cl.
CPC ..... *D03D 41/008* (2013.01); *D03C 13/00* (2013.01); *D03D 15/46* (2021.01)

(58) Field of Classification Search
CPC ..... D03D 41/008; D03D 15/46; D03C 13/00; D03C 3/22
See application file for complete search history.

(56) References Cited

U.S. PATENT DOCUMENTS 3,575,217 A * 4/1971 Pfarrwaller ..... D03D 47/368 139/452
3,731,713 A * 5/1973 Lachapelle ..... D03D 47/00 139/452

(Continued)

FOREIGN PATENT DOCUMENTS

CH 555906 A 11/1974
DE 2602511 A1 7/1976

(Continued)

OTHER PUBLICATIONS

Swan, "Coanda effect", 2011, Thermopedia, whole document' (Year: 2011).*

(Continued)

*Primary Examiner* — Robert H Muromoto, Jr.
(74) *Attorney, Agent, or Firm* — Westman, Champlin & Koehler, P.A.

(57) ABSTRACT

A method and an apparatus for producing a woven material from tape-like warps and wefts includes a warp supply source for tape-like warps; a shed forming device to form a shed by the warps; a weft insertion device for inserting tape-like weft in the shed formed by the warps; and a take-up device for taking-up the produced woven material. Each of the warps extend in warp paths between the warp supply source and the take-up device. Further, the shed forming device comprises an air pressure system arranged to apply pressure on the face of at least some of the warps in an intermediate position of the warp paths, between the warp supply source and the take-up device, the applied air pressure being sufficient to displace at least some warps in essentially the thickness direction of the tape-like warps.

14 Claims, 3 Drawing Sheets

(51) Int. Cl.
*D03D 15/46* (2021.01)
*D03D 41/00* (2006.01)

(56) References Cited

U.S. PATENT DOCUMENTS 3,848,642 A 11/1974 Steiner
3,881,523 A * 5/1975 Paton ..... D03C 13/00 139/436
3,918,501 A * 11/1975 Wolstencroft ..... D03D 47/00 139/452
4,347,872 A * 9/1982 Brouwer ..... D03D 47/306 139/435.1
4,503,889 A * 3/1985 van Mullekom .. D03D 47/3086 139/1 R
4,620,570 A * 11/1986 Suzuki ..... D03D 47/368 139/116.2
5,431,194 A 7/1995 Steiner et al.
6,450,208 B1 9/2002 Khokar
7,992,596 B2 8/2011 Khokar
9,169,584 B2 10/2015 Khokar
2007/0202798 A1* 8/2007 Billiotte ..... F24F 7/007 454/264
2008/0257443 A1* 10/2008 Khokar ..... D03D 1/0094 139/443
2014/0083553 A1 3/2014 Khokar

FOREIGN PATENT DOCUMENTS

DE 102012017002 A1 5/2014
GB 1365000 A 8/1974
JP 49-054670 5/1974

OTHER PUBLICATIONS

European International Search Report and Written Opinion for International Application No. PCT/EP2019/084263, dated Jan. 27, 2020, 10 pages.
Office Action from Japanese Application No. 2021-532021, dated Jun. 23, 2023.

* cited by examiner

SHEDDING METHOD AND APPARATUS USING AIR PRESSURE

CROSS-REFERENCE TO RELATED APPLICATION

This Application is a Section 371 National Stage Application of International Application No. PCT/EP2019/084263, filed Dec. 9, 2019 and published as WO 2020/120409 A1 on Jun. 18, 2020, in English, which claims the benefit of priority of European Application No. 18211841.4, filed on Dec. 12, 2018, the entire contents of which are hereby incorporated by reference in their entirety.

FIELD OF INVENTION

The present invention relates in general to weaving. In particular, it concerns the shedding operation wherein the displacement of tape-like warps is achieved by air pressure.

BACKGROUND

Shedding is the foremost operation of the weaving process. Its purpose is to displace the warps to create the shed. It performs selective displacement of the warps every weaving cycle to create a variety of weave patterns such as plain, twill, and satin.

Countless shedding methods have been developed over the years. Treadle, cam, dobby, jacquard methods are well known. In all these methods the shedding element, namely the heald/heddle, makes a physical contact with the warps no matter what their constructs be such as yarns, tows, and tapes. This is because each warp passes through the eye of the heald.

Shedding systems have also been developed wherein no healds are used to displace the warps, e.g. through different constructs of rotors such as those exemplified by GB 1365000, DE2602511, U.S. Pat. No. 5,431,194 for yarns, and U.S. Pat. No. 6,450,208 for tapes. In these systems too, the shedding element contacts the warps.

These available shedding systems cause damages to the warps, especially if they are of high-performance fibre types such as carbon, glass, and aramid, and relatively thin non-fibrous polymers such as polyethylene. The damage happens because the shedding system abrades and breaks the fine filaments of the warps whereby the mechanical properties of the produced woven materials get lowered. Such shedding systems increase the incidence of damages when the warps of such high-performance materials are in the form of tapes, especially the delicate spread fibre tapes, instead of the usual yarn/tow type, because in such tapes a greater number of fibres occur exposed and they get torn/parted. The warps of relatively thin non-fibrous polymeric tapes also get torn. Preservation of fibres' properties by preventing damage to the warps from shedding elements is therefore crucial when such high-performance fibres are to be used in composite materials and injury mitigation applications.

Abrasion caused by the shedding system to the warps also generates fibre-dust which in turn: (a) pollutes the air in the working-environment which could be harmful to the health of the operators if proper exhaust systems are not implemented, (b) increases the wear-tear of many working parts of the weaving machine, and (c) settles on the materials being woven, blemishing and impairing their quality. All these aspects ultimately increase the cost of production.

Another point of concern with the known shedding systems is that a relatively large inventory of spare parts and accessories must be maintained to reduce down-times and enable production of different weave patterns, processing of different widths of warp tapes etc.

As can be noticed, the existing shedding systems have certain drawbacks, apart from being possibly the most expensive system constituting the weaving machine.

To at least mitigate the various problems indicated in the foregoing that relate to processing warps of particularly spread-fibre tapes, non-fibrous polymeric tapes, tape-like flat-yarns/tows etc. types (henceforth collectively indicated as only tapes), and economic issues, a suitable shedding system is necessary.

SUMMARY OF THE INVENTION

Thus, an object of the present invention is to alleviate at least some, and preferably all, of the above-discussed problems. Accordingly, a novel method and apparatus to perform shedding using air pressure are disclosed here. Their relevant aspects are summarized below.

According to an aspect of the invention, there is provided an apparatus for producing a woven material from tape-like warps and wefts comprising:

- a warp supply source for tape-like warps;
- a shed forming device to form a shed by said warps;
- a weft insertion device for inserting tape-like weft in the shed formed by said warps; and
- a take-up device for taking-up the produced woven material;
- wherein each of the warps extend in warp paths between the warp supply source and the take-up device, and wherein the shed forming device comprises an air pressure system arranged to apply pressure on the face of at least some of the warps in an intermediate position of the warp paths, between the warp supply source and the take-up device, the applied air pressure being sufficient to displace said at least some warps in essentially the thickness direction of the tape-like warps.

In one embodiment, the air pressure for performing shedding is vacuum/suction air pressure.

In one embodiment, the shed forming device is arranged to form the displaced warps into a two-arm form.

In one embodiment, the apparatus further comprises a warp feeding system, for release of lengths of warp from the warp supply.

In one embodiment, the apparatus further comprises a controller arranged to control the release of lengths of warp in synchronization with the operation of the shedding device.

In one embodiment, the vacuum pressure system comprises a plurality of shedding ducts to exert a suction action on individual warps.

In one embodiment, the vacuum pressure is controllable to displace the warps without physically contacting the shedding ducts.

In one embodiment, the shedding ducts are controllable individually or in groups to exert displacing vacuum/suction pressure to displace a select number of the warps at a time.

In one embodiment, the shedding ducts are arranged on both sides of the warps and controlled selectively, thereby enabling displacement of the warps in two directions, both being in the thickness direction of the warps.

In one embodiment, at least some of the shedding ducts are moveable in a direction towards and away from the warps.

In one embodiment, the shedding ducts are further provided with a guard, preventing dragging of warps into the shedding duct.

According to another aspect of the invention, there is provided a method for producing a woven material from tape-like warps and wefts comprising:

providing tape-like warps from a warp supply;

forming a shed by said warps;

inserting tape-like weft in the shed; and taking up the produced woven material;

wherein each of the warps extend in warp paths between the warp supply source and the take-up device, and wherein the forming of the shed comprises applying air pressure towards the face of at least some of the warps in an intermediate position of the warp paths, between the warp supply source and the taking-up, the air pressure being sufficient to displace said at least some warps in essentially the thickness direction of the tape-like warps.

In one embodiment, the vacuum/suction air pressure is applied towards faces of warps directed in a first direction for a first set of warps, and towards faces of warps directed in a second direction, opposite to the first direction, for a second set of warps, thereby forming a symmetric shed.

A shedding method, using air pressure, is provided herewith for displacing the warp tapes to create sheds for accomplishing weaving. This shedding method preferably involves: (i) lifting a sectional length of each warp tape by applying air pressure, i.e. by blowing or vacuum/sucking air pressure, and forming it into a preferably gentle curving two-arm form after a specific length of the warp tape is fed towards the blowing and/or vacuum air zone, and (ii) supporting the curving two-arms of each lifted warp tape by blowing and/or vacuum air pressure in either contactless manner or in a gentle-contact manner with an element of the air pressure system for enabling weft insertion. Accordingly, the novel air pressure shedding method is henceforth called either the Air Shedding Method, ASM, (when air is blown) or Vacuum Shedding Method, VSM, (when air is sucked) according to the employed method.

Thus, under the influence of either constant or intermittent action of suitable air pressure, by blowing and/or sucking in the vicinity of the warp tape's surface(s), a sectional length of selected warp tapes fed by the warp-feeding system gets gently lifted/displaced from their respective level positions. The warp tapes which are not fed do not get lifted/displaced from their level positions in the shedding zone. When the blown air pressure and/or vacuum/suction air pressure is applied at the suitable face side(s) of the warp tapes, then the number of fed warp tapes get lifted/displaced in that corresponding direction while the others remain in their level positions creating the asymmetric shed. If the blown air pressure and/or vacuum/suction air pressure is applied at one face side of some of the warp tapes and it is also applied oppositely on the remaining warp tapes' face side, then some warp tapes get lifted/displaced in one direction and the remainder warp tapes get lifted/displaced in the opposite direction creating the symmetric shed. The selective feeding of warp tapes causes them to correspondingly get lifted/displaced and create the two types of sheds. Besides creating the sheds, the selective feeding of the warp tapes also aids creating different weave patterns such as plain, twills, and others.

Such an ASM/VSM significantly mitigates, if not altogether eliminates, the problem of abrading and damaging the warp tapes. The gentle working enabled by suitable air pressure of ASM/VSM is also advantageous in mitigating generation of fibre dust and its eventual spreading in the environment. It also requires no complex and expensive parts and arrangements to accomplish shedding. It also ensures virtually no stocking of either accessories or spare parts in inventory. Thus, ASM/VSM renders weaving relatively highly simple and economical. Preferably the shedding operation is performed by employing VSM for greater benefits.

In the context of the present invention, attention is drawn to US 2014/0083553 wherein lifting-up of the fore ends of tapes by vacuum is indicated. In this method of bias fabric manufacture, as discussed therein, there is no shed formed as it is technically not a weaving process. It involves the vacuum nipples to lift the free fore ends of the obliquely laid tapes. As can be understood, this method of lifting free fore ends is unlike the here-disclosed method wherein a sectional-length of the warp tape is lifted and curved into a two-arm form. Further, in US 2014/0083553 there is no warp-feeding system involved to feed a specific length of warp tape each weaving cycle. Therein, the entire required length of the tape is individually placed on the working bed because the method is not weaving, and no warp supply is required. Further, whereas the same free fore end of a warp tape is repeatedly lifted many times for a relatively small length of the bias fabric production in the method according to US 2014/0083553, this is not the case with the instant invention because a different section of the same warp tape is successively curved into a two-arm form once every weaving cycle until the entire warp length of the woven material's production is completed. Also, whereas the repeated lifting of the fore ends of the tapes for many times results in at least some fibre disturbances, tape distortion, tearing etc., there are no such impairments caused when curving a different section of the tape into a two-arm form only once every weaving cycle, i.e. the same part of the warp tape is never repeatedly curved.

The methods of feeding specific lengths of tape-like warps, inserting tape-like wefts in the sheds, taking-up the produced woven material which may be employed in conjunction with the present invention, can be exemplified by those indicated in U.S. Pat. Nos. 9,169,584 and 7,992,596. The warp-feeding and other systems are well-described in the indicated documents and require no detailing here. They are indicated to complement the understanding of the present inventions. After such a warp feeding arrangement has fed the required length of the selected warp tapes, the VSM enables corresponding shed formation and weave pattern.

Based on the positives obtainable from the unique VSM, compared to ASM, a shedding apparatus is disclosed according to another aspect of the invention. For indicated reasons and convenience, the novel apparatus is likewise called here the Vacuum Shedding System (VSS). The various relevant aspects of the method and apparatus are further detailed below.

As mentioned earlier, VSM involves suctioning air from the vicinity of a section of the warp tape's surface that faces a vacuum zone and feeding a specific length of select warp tapes whereby each of the tapes are gently displaced from their respective level positions and curved into a two-arm form to create the shed. Preferably, the warp tapes curve gently, not sharply. The shedding apparatus, or VSS, comprises essentially a vacuum generator, a vacuum distribution system, shed activator/s, and vacuum ports. The workings of the warp-feeding system and VSS are synchronised, just as all other weaving operations are synchronized relative to each other. The shedding and warp feeding apparatuses perform independent functions and they are located separated from each other. The warp feeding system is conveniently located at a suitable point in the warp path which originates at the supply spool source.

The weaving apparatus comprises the required various systems/units like a suitable warp supply source for tape-like warps, a shed forming device to form a shed by said warps (according to the present invention), a weft insertion device for inserting tape-like weft in the shed formed by said warps, a taking-up device for taking-up or advancing the produced woven material, preferably on the lines exemplified in U.S. Pat. Nos. 9,169,584 and 7,992,596, said documents hereby being incorporated in their entirety by reference.

The vacuum generator of the shed forming system is located preferably outside of the weaving apparatus, possibly even outside of the weaving hall. However, the vacuum generator is connected to the weaving apparatus by one or more suitable vacuum conveyors. A vacuum distributor is located suitably either inside or besides the weaving apparatus. This distributor may be of either a single 'large' unit type or multiple 'small' unit type; the latter offering increased flexibility in rendering the weaving machine relatively more compact because smaller units can be located more conveniently. Each distributor is provided with at least one primary vacuum port. Thus, depending on the arrangement implemented, either single or multiple type primary vacuum ports can be had. The primary vacuum port/s can be further extended and branched using suitable connectors and vacuum conveyors such as pipes, hoses, tubes etc. which can be of either rigid or flexible types, or a suitable part-rigid and part-flexible combination. Further, either some or all the ports of the multiple type primary vacuum ports can be made to function either independently or in suitable groups. The primary vacuum port/s down the line are connected to either a single secondary vacuum duct or multiple secondary vacuum ducts each of which are preferably individually operable. Alternatively, multiple individual units can be had each of which has an independently operable secondary vacuum duct.

The above-mentioned different types of secondary vacuum ducts are commonly called here the Shed Activator. These secondary vacuum ducts of the Shed Activator are called here the Shedding Ducts. The Shedding Duct is thus a part of the Shed Activator. The Shed Activator thus has at least one Shedding Duct. Preferably each Shedding Duct of the Shed Activator is located near about the fabric-fell in a manner that the Shedding Duct faces individual warp tapes' surface. The Shed Activator may be located at either front or back surfaces of the warp tapes, or at both the front and back surfaces of the warp tapes depending on the corresponding asymmetric or symmetric types of sheds to be created in accordance with the warp tape's material nature, areal weight, rigidness etc. In all cases the vacuum action by the Shedding Ducts displaces the warp tapes in their thickness-direction to form the shed.

According to one arrangement, there is only one common operable Shedding Duct, such as with a longitudinal opening or slit, for all the warp tapes of the material being woven. According to another arrangement there are, either individual or grouped, operable Shedding Ducts for the warp tapes being processed. If in an arrangement there are extra Shedding Ducts than the number of warp tapes, then they can be rendered inoperable. The Shedding Ducts of the latter arrangement can be of suitable forms and are serially arranged in the direction of all the side-by-side arranged warp tapes. Thus, the arrangement of operable Shedding Ducts, whether individual or grouped, corresponds at least to the number of warp tapes being woven.

The Shed Activator is preferably modular in construction whereby it can be attached to, or detached from, the vacuum conveyor/s extending from the distributor. The Shed Activator may be of either the extendable-contractible type or the rigid type. Further, the Shed Activator may be of either the stationary type or the reciprocating type. Further, the Shed Activator functions either individually or in suitable one or more groups. In any case, the Shed Activator is preferably individually and automatically made to function to either draw the corresponding facing individual warp tapes closely towards its Shedding Duct when fed by the warp feeding system, or to release them for shed closing and fabric taking-up/advancing operations. Such individual activation of the Shed Activator is advantageous in creating different weave patterns like plain, twill, and others without requiring use of different parts whereby inventory of such accessories is rendered redundant.

Further, the Shedding Ducts of the Shed Activator are positioned at a suitable safe distance from each facing warp tapes' surfaces. This distance of separation is pre-determined in accordance with the applied operating vacuum pressure, and the structural nature, areal weight of the warp tapes, and the length of the warp tape released by the warp-feeding system etc. Thus, if warp tapes of different characteristics are to be woven in the same woven material then suitable different vacuum pressures can be employed/applied to suit the individual warp tapes. For flimsy or relatively low areal weight warp tapes a relatively low vacuum pressure is preferable. In any case the vacuum pressure and position of a Shedding Duct are such that the warp tapes either do not contact the respective Shedding Ducts or make a gentle contact/touch with the Shedding Duct during shed formation. By 'gentle contact or touch' of the warp tape with the Shedding Duct is implied that the action does not result in the warp tapes suffering from one or more types of damages indicated earlier.

The length of each warp tape required for creating the shed is fed by the warp-feeding system every weaving cycle by drawing out a measured/specific length of warp tape from its respective supply spool/source. Preferably each fed warp tape gets formed into a curving two-arm form when displaced by the respective operational Shedding Duct and create the shed. The Shedding Duct supports the tape in its curving two-arm form in either contactless manner or gentle-contacting/touching manner for the duration the shed is required to be maintained for enabling insertion of the weft. In the contactless type of support, the tape occurs 'floatingly' in the curved two-arm form. The curving two-arm form in either case is preferably not pointed or sharp but has at least one curving radius to prevent tape's creasing and/or cracking. The tape smoothly curves into a two-arm form during the creation and maintenance of the shed.

Further, the vacuum action preferably generates tension in each of the two arms of the curving warp tape whereby both the arms remain at least somewhat firm/taut. This is important for creating a clear passage for inserting the weft.

When shedding warp tapes of low areal weight, or delicate, or fragile types, it is preferable to have the asymmetric shed formation by displacing the required warp tapes into curving two-arm form while keeping the remainder warp tapes straight to lower the problem of deformation of tape-like wefts, particularly of the low areal weight, or delicate, or fragile types. Symmetric shed formation, wherein some warp tapes are displaced in one direction and the remainder warp tapes are displaced in the opposite direction, causes the just-indicated tape-like wefts to crumple, distort and deform. Symmetric shed formation is preferable when the weft tapes are of relatively high areal weight, stiffness, structural stability etc.

Preferably the Shedding Duct is equipped with a suitable mesh or guard-frame to prevent any accidental pulling-in of long lengths of warps into the vacuum distribution system or the vacuum generator. The mesh or guard covering the Shedding Duct preferably lets in the inevitable loose fibres into the filter unit of the Shed Activator. Any loose fibres caught on the mesh or guard-frame can be physically removed from time to time. Thus, the VSS also advantageously functions to remove loose fibres near the Shedding Ducts and thereby prevents settling of such loose fibres on the produced woven material, and thereby keeping its quality unblemished. Also, capturing of loose fibres minimizes their settling on machine parts, increasing their service life. Further, the Shed Activator is preferably equipped with a suitable filter unit to trap fibres escaping through the mesh or guard-frame.

Further, depending on the areal weight of the warp tapes to be processed, the Shedding Duct/s can be designed with either single mouth or multiple grouped mouths. The latter type can be used in situations requiring each warp tape to be controlled with relatively higher precision. Another advantage of the multiple grouped mouth Shedding Duct is that any required mouth can be further suitably individually operated according to the needs of the process for economic advantage and for lowering the air suction noise. Also, a multi-mouth Shedding Duct advantageously enables displacement of warp tapes of a wide range of areal weights to create the shed as its different mouths can be suitably operationalized.

Further, the Shedding Duct/s need not be necessarily flat; they can be suitably curved and/or angled to effectively deflect/guide the air being sucked. Further, the multiple mouths of the Shedding Duct need not necessarily occur in a single line or file; they could be had in suitable relatively different arrangements such as zig-zag or parallel or mutually angled or mutually facing etc. Also, the shape of the Shedding Duct need not be necessarily circular; it can be of any suitable shape, for example of either regular or irregular or their combination geometrical shapes.

Further, the Shed Activator is of either the fixed type or the adjustable type whereby the distance of its Shedding Duct can be suitably set from the surface of the facing warp tapes so that the applied vacuum pressure can be effectively and efficiently utilised for different areal weights of warp tapes and in keeping the production or weaving costs relatively low. Also, for effective and efficient utilization of vacuum pressure, and hence economic reason, the Shedding Ducts are preferably timed to operate just prior to the warp-feeding system releasing the required length of warp tapes.

Further, preferably the same Shed Activator can receive different arrangements of Shedding Ducts. Such a modular Shed Activator thus enables processing of a wide variety of warp tapes in terms of width, areal weight, materials, delicateness, structural stability etc. The modular construct of the Shed Activator also lends itself to render the weaving machine relatively easily adaptable for weaving different materials. This possibility uniquely eliminates the need to maintain an inventory of many spare parts and accessories. Because required Shedding Ducts can be made operable whenever required, weaving of materials with tapes is rendered relatively more economical.

Further, advantageously the Shed Activators may be arranged in correspondence with any desired orientation of the warp tapes' arrangement to perform weaving. For example, the Shed Activators may be arranged in horizontal orientation to perform vertical weaving, or in vertical orientation to perform horizontal weaving, or in a suitable angular orientation to perform angular weaving, or in vertical orientation to perform vertical weaving etc. Thus, the VSS offers high adaptability for weaving in any suitable or preferred format.

Further, because VSS involves almost no moving parts, there is virtually no generation of vibrations and noise associated with the known shedding systems. This aspect is highly advantageous in that VSS contributes to a large extent in lowering the problem of hearing impairment encountered by the weavers and mechanics. Also, because of its relative non-vibrating operation, the construction of weaving hall's foundation, flooring and walls is rendered economical, and the working ambience relatively less noisy. Also, its non-vibrating nature reduces wear-and-tear of many components on a weaving machine whereby downtimes and costs get lowered.

Needless to state, insertion of the weft tapes in the shed created by the VSM and VSS, together with other weaving actions/operations, lead to accomplishing production of a woven material comprising tape-like warps and wefts.

The various described aspects, embodiments, and features of the present inventions of VSM and VSS will become clearer from the illustrations and the description that follow next.

BRIEF DESCRIPTION OF THE DRAWINGS

The present inventions relating to VSM and VSS are illustrated in the following drawings by way of examples wherein.

DETAILED DESCRIPTION OF THE RELEVANT EMBODIMENTS

Figure 1:
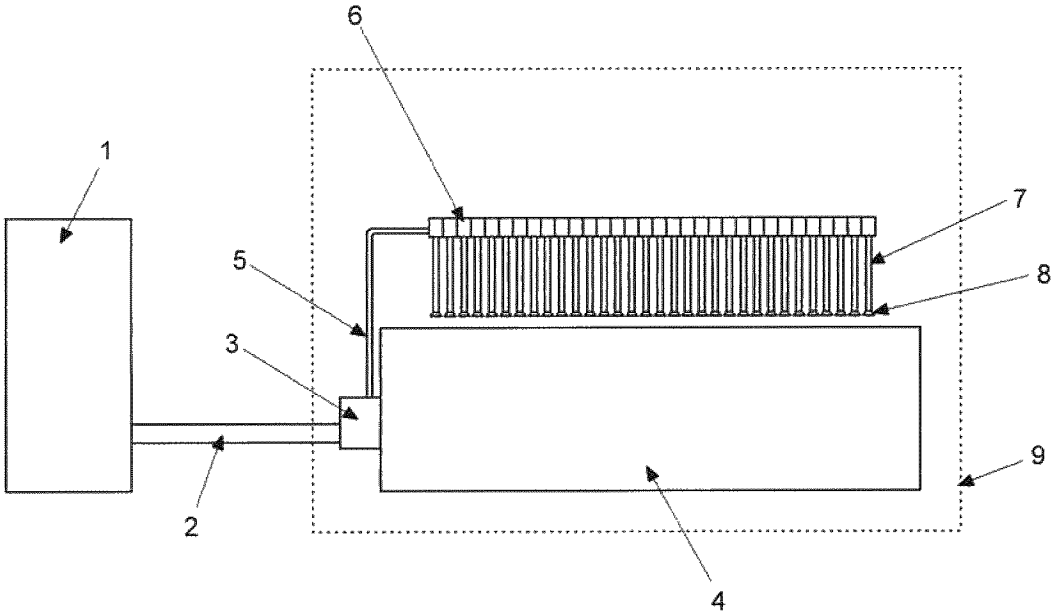
FIG. 1 exemplifies the relative arrangements of the main components of VSS, namely vacuum generator, vacuum distribution system, and Shed Activator with Shedding Ducts.

In the following detailed description, relevant embodiments of the present inventions are described. It is to be understood that features of the different embodiments are changeable and may be combined in different ways, unless anything else is specifically indicated. It may be also noted that, for the sake of clarity, the dimensions of certain things illustrated in the drawings may differ from the corresponding dimensions in real-life implementations of the invention. Even though in the following description numerous specific details are set forth to provide a more thorough understanding of the present inventions, it will be apparent to one skilled in the art that the present inventions may be practiced with modifications to the specific details. In other instances, the commonly known constructions and/or functions to a person skilled in the art are not described in detail to not obscure the present inventions.

A VSS, based on VSM of the present invention, is described in reference to FIGS. 1 and 2. For ease of representation the asymmetric shed formation in the usual horizontal weaving format is considered here, although any other weaving format, such as vertical and angular formats, could be similarly considered by a skilled person. Further, the VSS having multiple secondary vacuum ducts is illustrated for broader understanding. A person skilled in the art will be able to perform shedding with the single secondary vacuum duct as well.

FIG. 1 shows an arrangement of the various preferred parts of a VSS. A weaving apparatus (4), for weaving material using warp tapes and weft tapes, is housed in a weaving hall (9). A vacuum generator (1), preferably situated outside of the weaving hall (9), is connected through primary vacuum conveyor (2) to a distributor (3) which is, for example, attached to the side of a weaving apparatus (4). One end of a secondary vacuum conveyor (5) is attached to a primary vacuum port of the vacuum distributor (3). The other end of the secondary vacuum conveyor (5) is preferably attached suitably to the first connector (6) of the modularly attached Shed Activator (7). At convenient a side of the Shed Activator (7) is attached a suitable Shedding Duct (8). A series of Shed Activators (7) with the Shedding Ducts (8) are modularly interconnected through respective connectors (6) of each Shed Activator (7). All these indicated components are suitably supported and fixed on the weaving apparatus (4).

Figure 2A:
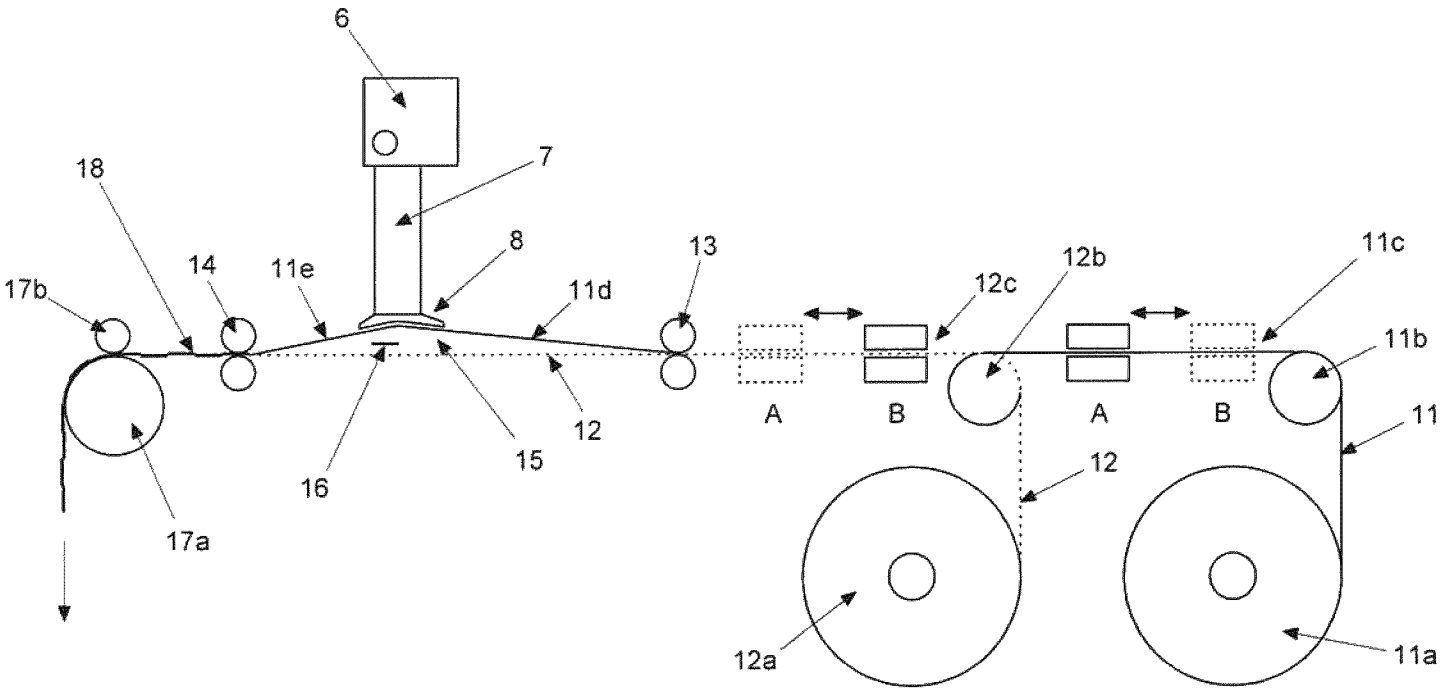
FIGS. 2*a* and 2*b* exemplify shed formation through use of VSS.
Figure 2B:
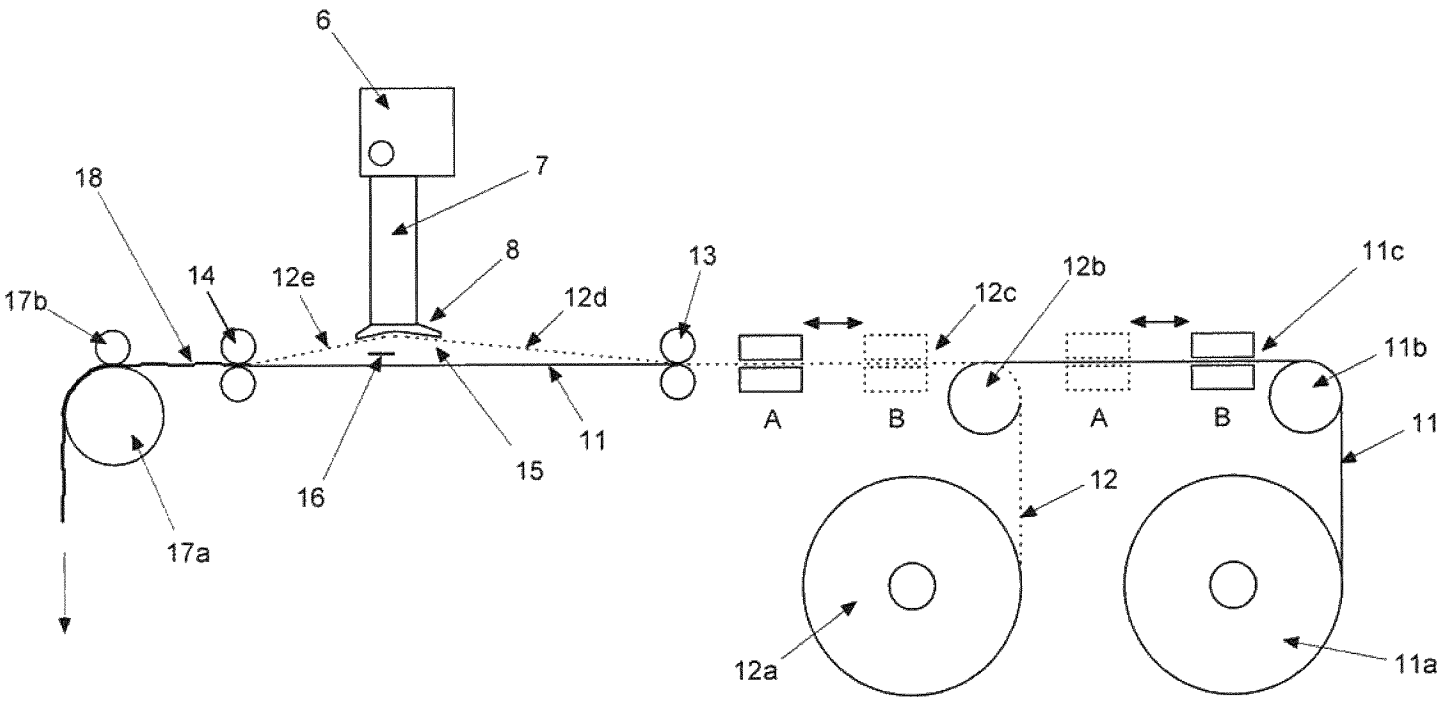

FIGS. 2*a* and 2*b* show the tape-weaving apparatus (4) in its side view together with the relevant parts (6, 7, 8) of the novel Vacuum Shedding System. For ease of explanation, production of plain weave is considered. Serially arranged warp tapes are supplied from either one or more than one set of sources. While the former may be exemplified by one beam on which all the side-by-side serially arranged warp tapes occur, the latter could be, for example individual spools which are serially arranged side-by-side in suitable number of groups. In FIG. 2 is indicated an arrangement wherein two groups of warp tapes (11 and 12) are sourced from corresponding spools (11*a* and 12*a*) which are positioned, for example in two different vertical planes to practically facilitate their accommodation and access on the weaving machine. Warp tapes (11 and 12), individually drawn from their sources (11*a* and 12*a*), are respectively guided over the rolls (11*b* and 12*b*) and pass through the respective warp-feeding arrangements (11*c* and 12*c*). All the serially occurring warp tapes of the two groups are then commonly drawn between the nipping rollers (17*a* and 17*b*) of the fabric take-up system. The ends of the warp tapes are finally attached to the fabric winding roller (not shown). Back and front paired rollers (13 and 14) respectively are suitably positioned in the linear warp path to define the geometry of the sheds to be produced for weaving tape-like warps and wefts. Warp-feeding units (11*c* and 12*c*) alternately reciprocate between their respective set positions (A and B) to feed the warp tapes of one group towards the shedding system (6, 7, 8) to successively form sheds (15) for enabling insertion of the weft tapes (16) to obtain a woven material (18) of plain weave pattern. In the indicated arrangement, the fabric-fell position is nearer to a side of the paired rollers (14) which faces the Shedding Ducts (8). Instead of paired rollers (14), some other suitable arrangement could be also considered, e.g. paired bars/plates.

Formation of shed (15) by the Vacuum Shedding System is as follows. Referring to FIG. 2*a*, each required Shed Activator (7), through their connection to the secondary vacuum duct (6), are operated whereby the corresponding attached Shedding Ducts (8) directs suction of air from the vicinity of the facing warp tapes (11) concerned. When the warp tapes (11) are fed by the warp-feeding arrangement (11*c*) towards the direction of shedding system (6, 7, 8), the vacuum pressure in the Shedding Ducts (8) draws and displaces the fed warp tapes (11) towards itself and causes the warp tapes (11) to smoothly curve into a two-arm form (11*d* and 11*e*). Such a displacement of the warp tapes (11) in a curving two-arm form (11*d* and 11*e*), in relation to the linearly occurring warp tapes (12), results in the formation of shed (15). Each operating Shedding Duct (8) supports the corresponding warp tape in the curving two-arm (11*d* and 11*e*) form through vacuum pressure and generates tension in them. After weft (16) has been inserted in shed (15) and positioned at fabric-fell, the fabric take-up rollers (17*a* and 17*b*) are operated to advance the just-created woven material (18) which is simultaneously wound on the fabric roll (not shown). The edge of the just-inserted weft (16) facing the Shedding Ducts (8) now re-establishes the fabric-fell position. As the advancement of woven material (18) happens, the vacuum supply in the Shed Activator (7) is switched off from secondary vacuum duct (6) causing the curving two-arms (11*d* and 11*e*) of warp tapes (11) to lose support and hence get released from Shedding Ducts (8) and level with the non-displaced warp tapes (12) as all the warp tapes are pulled by the take-up rollers (17*a* and 17*b*).

In the next weaving cycle, as shown in FIG. 2*b*, each of the required Shed Activator (7), through their connection to the secondary vacuum duct (6), are operated whereby each of the attached Shedding Ducts (8) directs suction of air from the vicinity of the warp tapes (12) concerned. As the warp tapes (12) are fed by the warp-feeding arrangement (12*c*) towards the direction of shedding system (6, 7, 8), the vacuum pressure in the Shedding Ducts (8) draws the fed warp tapes (12) towards itself and causes the warp tapes (12) to smoothly curve into a two-arm form (12*d* and 12*e*). Such a displacement of the warp tapes (12) in a curving two-arm form (12*d* and 12*e*), in relation to the linearly occurring warp tapes (11), results in the formation of a new shed (15). Each operating Shedding Duct (8) supports the curving two-arms (12*d* and 12*e*) through the vacuum pressure and generates tension in them. After weft (16) has been inserted in shed (15) and positioned at fabric-fell, the fabric take-up rollers (17*a* and 17*b*) are operated to advance the just-created woven material (18) which is simultaneously wound on the fabric roll (not shown). The edge of the just-inserted weft (16) facing the Shedding Ducts (8) now re-establishes the fabric-fell position. When the advancement of woven material (18) happens, the vacuum supply from in the Shed Activator (7) is switched off from secondary vacuum duct (6) causing the curving two-arms (12*d* and 12*e*) of warp tapes (12) to lose support and hence get released from Shedding Ducts (8) and level with the non-displaced warp tapes (11) as all the warp tapes are pulled by the take-up rollers (17*a* and 17*b*).

Alternate displacement of warps tapes (11 and 12) for shed formation by the described VSM and VSS, in conjunction with other required sequential weaving operations, in a cyclical manner accords continuity to the production of woven material (18).

A person skilled in the art will see now numerous possibilities in the manner VSM can be performed and VSS can be organized and operated. For example, Shed Activator (7), together with its Shedding Duct (8), can be either reciprocated or extended-contracted between two points—one, to be close to the level warp tapes, and the other to be at the necessary distance supporting the smoothly curving two-arm form of the displaced warp tapes for creating the shed for safe passage of the weft. This way the vacuum pressure can be highly effectively utilized besides imparting greater controlled movement to the warp tapes during shed formation. This idea of reciprocating Shed Activator (7)—Shedding Duct (8) could be also implemented in an oscillating manner whereby they are made to swing back and forth in synchronization with feeding of the warp tapes. Another approach would be to render the construct of the secondary vacuum duct (6), Shed Activator (7) and Shedding Duct (8) suitable for a rotary type arrangement. For further functional improvements of VSS, the following could be considered: (i) periodic self-cleaning by automatic discharge of filters with collected fibres, (ii) its self-aligning with warp tapes during weaving process, e.g. through vision cameras or sensors, (iii) quick-adapting constructs whereby the same Shed Activator (7) and/or Shedding Duct (8) can be used for performing shedding for a range of different warp tape widths, (iv) Shedding Ducts (8) equipped with air or spring or soft-material cushions to ensure that the warp tapes make a gentle touch/contact with it, (v) Shed Activator (7) and/or Shedding Duct (8) equipped with sensors for detecting missing or deformed warp tapes and halting the weaving apparatus for rectification, and (vi) Shed Activator (7) and/or Shedding Duct (8) incorporating manual/automatic vacuum regulator, air-suction noise absorbers, individual light indicators for drawing attention to rectify operational problems etc.

A person skilled in art will be now also able to apply the Air Shedding Method and develop a suitable Air Shedding System on lines similar to VSM and VSS for weaving with tape-like warps by blowing air.

Such and other obvious modifications must be considered within the scope of the present invention, as defined by the appended claims. It should be noted that the above-mentioned embodiments illustrate rather than limit the invention, and that those skilled in the art will be able to design many alternative embodiments without departing from the spirit and scope of the appended claims. In the claims, any reference signs placed between parentheses shall not be construed as limiting to the claim. The word "comprising" does not exclude the presence of other elements or steps than those listed in the claim. The word "a" or "an" preceding an element does not exclude the presence of a plurality of such elements. Further, a single unit may perform the functions of several means recited in the claims.

The invention claimed is:

1. An apparatus for producing a woven material from tape-like warps and wefts comprising:

a warp supply source for tape-like warps;

a shed forming device to form a shed by said warps;

a weft insertion device for inserting tape-like weft in the shed formed by said warps; and a take-up device for taking-up the produced woven material;

wherein each of the warps extend in warp paths between the warp supply source and the take-up device, and wherein the shed forming device comprises an air pressure system arranged to apply pressure on the face of at least some of the warps in an intermediate position of the warp paths, between the warp supply source and the take-up device, the applied air pressure being sufficient to displace said at least some warps in essentially the thickness direction of the tape-like warps; and wherein the air pressure for performing shedding is vacuum/suction air pressure, the vacuum pressure system comprising a plurality of shedding ducts to exert a suction action on individual warps, at least some of the shedding ducts being moveable in a direction towards and away from the warps.

2. The apparatus of claim 1, wherein the shed forming device is arranged to form the displaced warps into a two-arm form.

3. The apparatus of claim 1, further comprising a warp feeding system, for release of lengths of warp from the warp supply.

4. The apparatus of claim 3, further comprising a controller arranged to control the release of lengths of warp in synchronization with the operation of the shedding device.

5. The apparatus of claim 1, wherein the vacuum pressure is controllable to displace the warps without physic contact between the warps and the shedding ducts.

6. The apparatus of claim 1, wherein the shedding ducts are controllable individually or in groups to exert displacing vacuum/suction pressure to displace a select number of the warps at a time.

7. The apparatus of claim 1, wherein shedding ducts are arranged on both sides of the warps and controlled selectively, thereby enabling displacement of the warps in two directions, both being in the thickness direction of the warps.

8. The apparatus of claim 1, wherein the shedding ducts are further provided with a guard, preventing dragging of warps into the shedding duct.

9. A method for producing a woven material from tape-like warps and wefts comprising:

providing tape-like warps from a warp supply;

forming a shed by said warps;

inserting tape-like weft in the shed; and taking up the produced woven material;

wherein each of the warps extend in warp paths between the warp supply source and the take-up device, and wherein the forming of the shed comprises applying air pressure towards the face of at least some of the warps in an intermediate position of the warp paths, between the warp supply source and the taking-up, the air pressure being sufficient to displace said at least some warps in essentially the thickness direction of the tape-like warps, wherein the air pressure for performing shedding is vacuum/suction air pressure provided by a vacuum pressure system comprising a plurality of shedding ducts to exert a suction action on individual warps, and wherein at least some of the shedding ducts are moveable in a direction towards and away from the warps.

10. The method of claim 9, wherein vacuum/suction air pressure is applied towards faces of warps directed in a first direction for a first set of warps, and towards faces of warps directed in a second direction, opposite to the first direction, for a second set of warps, thereby forming a symmetric shed.

11. The apparatus of claim 1, wherein each of the shedding ducts is arranged to draw an individual warp towards itself when exerting a suction action on the individual warp.

12. The apparatus of claim 1, wherein the shedding ducts are provided with a mesh to prevent dragging of warps into the shedding duct.

13. The apparatus of claim 1, wherein the shedding ducts are positioned at a distance from each facing warp tape's surface.

14. The apparatus of claim 1, further comprising a vacuum generator and one or more vacuum conveyor connecting the vacuum generator to the shedding ducts.

* * * * *